United States Patent [19]

Zankl

[11] Patent Number: 4,708,778

[45] Date of Patent: Nov. 24, 1987

[54] METALLIZING FIBER RE-INFORCED COMPONENT

[75] Inventor: Wolfgang Zankl, Friedrichshafen, Fed. Rep. of Germany

[73] Assignee: Dornier GmbH, Friedrichshafen, Fed. Rep. of Germany

[21] Appl. No.: 893,632

[22] Filed: Aug. 6, 1986

[51] Int. Cl.[4] ..... C25D 7/04

[52] U.S. Cl. ..... 204/25

[58] Field of Search ..... 204/25

[56] References Cited

U.S. PATENT DOCUMENTS 950,777 3/1910 Winslow ..... 204/25

FOREIGN PATENT DOCUMENTS 17627 9/1972 Japan ..... 204/25

*Primary Examiner*—T. M. Tufariello

*Attorney, Agent, or Firm*—Ralf H. Siegemund

[57] ABSTRACT

A part or component made of a fiber re-inforced compound and having some hollow or concave portion which is not to be metallized, is provided with a wall extension adjacent the hollow or concave portion not to be metallized, which is closed and sealed off. Prior to metallizing the compound is cleaned, metal is electrolytically deposited on at least some of the outer surface parts of that compound and subsequently, the closure as well as the wall extension is removed.

10 Claims, 2 Drawing Figures

METALLIZING FIBER RE-INFORCED COMPONENT

BACKGROUND OF THE INVENTION

The present invention relates to the depositing of metal layers or coatings upon the surface of a part or component made of a synthetic or plastic material, and more particularly the invention relates to such a method for depositing metallic layers on fiber re-inforced synthetic material and components made of such a material which are basically hollow but of open construction, possibly having spherically curved surfaces or surface parts, under consideration that the parts are subjected to a material removing treatment as a preparatory step for the depositing or coating process.

Metal foils or sheets are placed upon a carrier body made of a synthetic material, for example, in the art of printed circuit manufacture, using, for example, adhesive bonding to obtain a sufficiently strong connection between support or carrier and the metal foil or sheet. Generally, the support is flat, i.e. planar, and technology for depositing these foils or sheets on such support are adequately developed and do not pose difficulties at the present time. The situation is different, however, when the carrier surface is curved, for example, spherically curved or even of complex curvature such as combined convex and concave surface portions. Here then the depositing of areal metal foil, parts, sheets, or the like, is usually not possible without forming folds or crinkles, assuming, of course, that the curvature is a significant one and is insufficiently approximateable by a straight geometric plane.

Large numbers of parts to be coated or clad, or layered in this fashion, seem to require matching the foil or sheet part to the contour of the surface of the carrier; this in turn, may require shaping the foil or sheet with suitable tools and machines followed by accurate placing and bonding. Basically, this procedure requires tools which are to be matched exactly for that purpose whenever large quantities are involved, these capital layout expenditures may be justified. The situation is different, however, when the number of parts is small. Here then the matching of the contour of the foil or plates to the contour of the carrier or substrate can become very cumbersome and expensive.

Particular difficulties in contour matching of this type will develop when only a portion of the surface of the carrier are to be covered with metal. A simpler approach here is the utilization of electrolytic depositing in order to cover, for example, a part made of non-metal, such as a synthetic part, completely or partially with a metal coating. In the case of fiber re-inforced synthetic wherein the component has, for example, a curved surface portions, the depositing of a metal coating by means of electrolytic technique requires initially to render the surface of the synthetic part electrically conductive so as to be able at all to obtain electrolytic deposition of metal thereupon.

Certain materials having supporting functions generally, such as load bearing structure parts in aircraft, airborne vehicles, and analogous crafts, require, of course, a dimensioning that is dictated primarily by the expected load. Such part has to take up, while, on the other hand, low weight is a highly desirable feature in the aerospace industry. With this as background one has to consider the possibility that some of these parts have curved surfaces spherical or complex ones, at least in parts, and one may invision a structural material being comprised of fiber reinforced epoxy resin. Such a part, for example, may require to be coated in parts with metal to function as a transmission or receiving antenna. Here then specific problems arise concerning adequate adhesiveness of the coating, owing to the formation of a skin made of a separating material and which remains depositing on the surface of a part after it has been manufactured; the manufacture process of fiber re-inforced synthetic parts often requires such separation. The separating material, on the other hand, will prevent adequate adhesion of the subsequently deposited metallic coating, and surprisingly the usual cleansing methods are insufficient to really completely remove such separating material.

Generally speaking, particular methods are used for mechanically and/or chemically surface treat a part in order to prepare it for coating. What is involved here is actually the removal of a thin surface layer for cleaning purposes. Here then the danger exists, irrespective of the effectiveness of this cleaning, that the surface as such is being damaged in the cleaning process. This is particularly the case when the surface is primarily formed of a synthetic material. But also re-inforcing fibers which are close to the surface may be cut or otherwise damaged. Such a damage, even though seemingly minimal, may, in fact, interfere with the strength requirements. This is a particularly important feature if the part is expected to take up significant load and when weight constraints preclude excess dimensions. The problem actually is compounded if a partial coating is required only so that only parts of the surface of the component is so treated and, therefore, subjected to strength interfering damage, etch-treating surface portions which will not be covered by a coating subsequently is undesirable for a variety of reasons. In order to avoid the cleaning of surface parts which are not to be coated, these are covered by ribbons or the like prior to etch cleaning, in order to avoid exposure to the cleaning agent. These partial surface coverings, however, again are difficult to accomplish for reasons of the curvature. Access to the interior of the parts may be difficult or even impossible.

DESCRIPTION OF THE INVENTION

It is an object of the present invention to provide a new and improved method for preparing at least parts of the surface of a fiber re-inforced synthetic component having spatially curved surface portions and being, for example, a load bearing part, for receiving a firmly adhering metal coating, such as a copper coating.

It is a particular object and feature of the present invention to provide a new and improved method for electrolytically depositing a metal coating, such as a copper coating, on components having a curved surface or surface portion and being made of a fiber re-inforced synthetic material, under avoidance of chemical or mechanical action on those parts of the surface of that component which are not to receive a metal coating.

It is a further particular object of the present invention to improve a metal coating process on parts which have a hollow or concave contour such that the hollowness or concave surface parts are not to be coated.

In accordance with the preferred embodiment of the present invention, the objects are attained in that prior to electrolytical depositing surface parts not to be coated, but during manufacture of the respective component it is provided with a wall part or other comparable extension, projecting out of a hollow opening of the part and beyond the dimensions of the final part are to have; this wall extension will receive a closure part for closing off those parts or even the entire hollow concave interior not to be coated; at least some of the remaining surface portions of the part is to be coated. Cleaning may precede but preferably will succeed the closing step; thereafter coating occurs. The cleaning process may be a mechanical one, and closing off of the interior may not be necessary at that time but in the case of chemical cleaning it is more practical to close off the interior prior to cleaning. A factor here is whether or not unnecessary cleaning of the interior weakens the past.

The particular extension with closure is removed subsequent to completion of the metal coating process. The closure is preferably carried out in a liquid-tight fashion; actually the hollow of the part should be filled with an electrically neutral liquid after cleaning. The interior should be vented, particularly during the galvanic depositing process in such a manner that liquid in the interior of the part will not excape while liquid from the electrolytic bath does not enter the interior. The hollow may be provided with a flange permitting the affixing of the closure element.

By means of the inventive method, wrinkle free coating of those parts of the surface which are to be coated is readily attainable, because one uses the inherent contour matching capability of the electrolytic depositing process whithout, however, encountering the drawbacks that occur on preparation of parts which was experienced in the past. Moreover, covering of surface parts to be protected against mechanical and/or chemical cleaning action in preparation for the coating process, is replaced, as far as hollow or concave spaces are concerned by sealing off rather than surface covering those hollow and/or concave surface parts and portions of the component being treated. The called for extension projects beyond the normal boundary confines or border of the hollow interior of the component in question. This extension has to be removed subsequently because it is superfluous. The extension is preferably made originally as an integral part, and even though it has to be removed by a separate post-coating step, this approach was found to be a significant facilitation, as far as the overall process and working is concerned, even though one actually provides initially a superfluous item and removes it after it has fulfilled its temporary function. The removing of the closure for the hollow part and removing also, i.e. separating, the extension that is needed for accommodating the closure, is a very simply completed on that removal. Particularly making this extension integral with a manufacture of a synthetic fiber re-inforced part constitutes a significant labor and time saving approach.

Owing to sealing the interior of the component and filling it with an electrically neutral liquid one avoids particularly the buoyancy which the hollow and sealed component would otherwise exhibit when immersed in the electrolytic bath. Also, any tendency of the part to deform on account of an inside/outside pressure differential is avoided, the electrically neutral liquid in the interior will readily balance the exterior pressure of the electrolytic bath. Here then, it has to be observed that pressure differentials may occur not so much on account of hydrostatics but on account of a temperature increase in the electrolytic bath which is heavily traversed by electrical current.

DESCRIPTION OF THE DRAWINGS

While the specification concludes with claims, particularly pointing out and distinctly claiming the subject matter which is regarded as the invention, it is believed that the invention, the objects and features of the invention, and further objects, features and advantages thereof will be better understood from the following description taken in connection with the accompanying drawings in which:

In both figures the electrolytical deposit equipment, including an electrolytic bath and incorporatedg components are illustrated only highly schematically because, as far as the electrolytic depositing process is concerned, Applicant relies on the known techniques.

Figure 1:
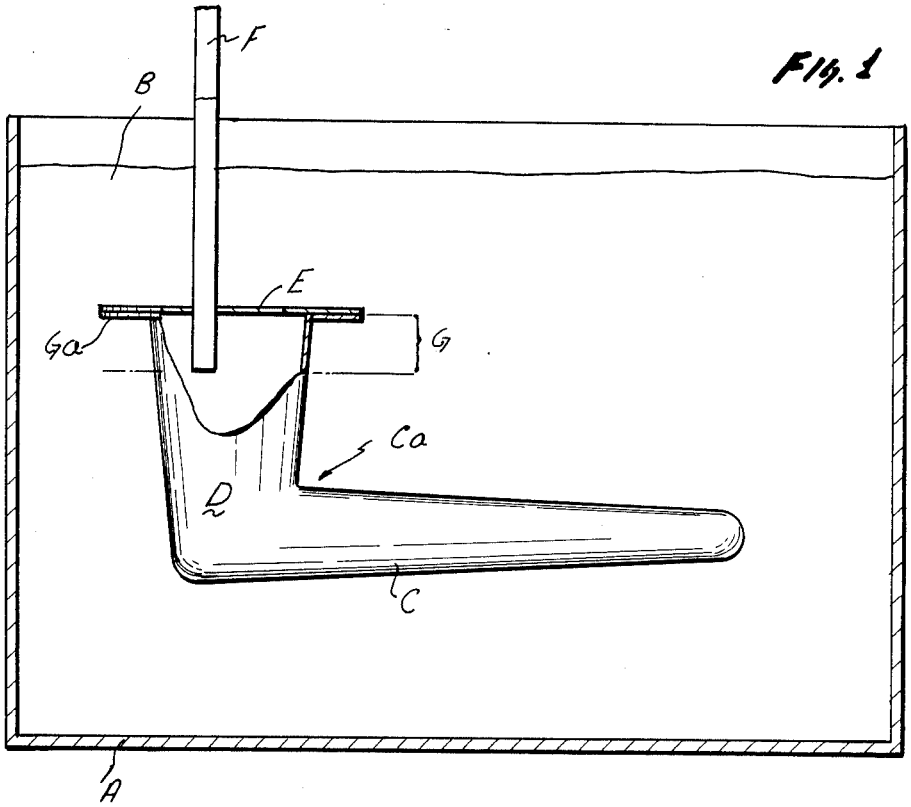
FIG. 1 illustrates somewhat schematically a view of a first example and embodiment for practicing the preferred embodiment in accordance with the best mode of the invention.
Figure 2:
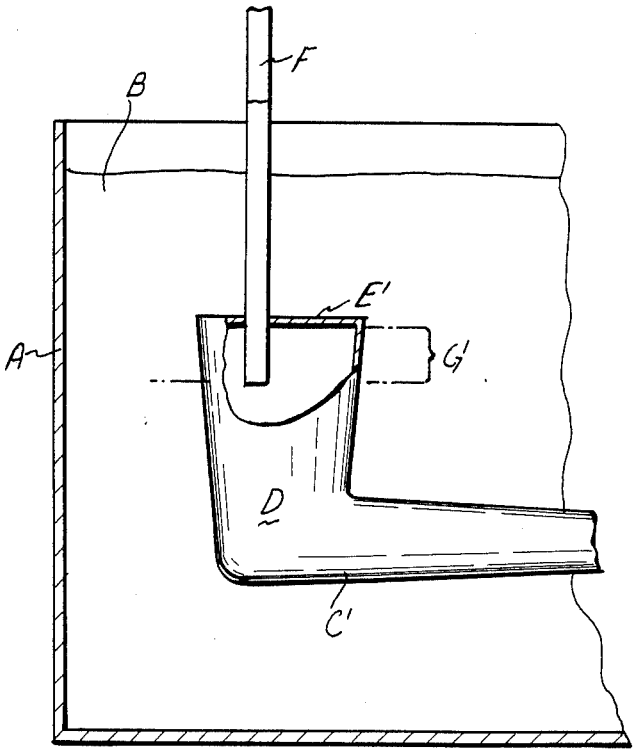
FIG. 2 illustrates a similar view involving practicing the invention in conjunction with a somewhat differently contoured part to be treated.

The part to be treated, i.e. to be electrolytically coated with a metal coating, is denoted by reference character C in FIG. 1 and C′ in FIG. 2. The part C, for example in FIG. 1, is made of a fiber re-inforced synthetic material and has a rather complex contour. It can be interpreted geometrically as a 90 degree intersection of two truncated cones with a rounded peak. Geometric complexity is particularly evidenced by the convex/-convave "corner" portion Ga.

After copper depositing on the outside, the part C is to serve as an antenna reflector. Accordingly, the equipment shown in FIG. 1 is to provide a copper coating on the outside of part C without, however, coating the inside. The inside could be, but does not have to be, cleaned prior to metal coating. Reference character G in FIG. 1 denotes a trunketed cone-like integral extension from the part C, having, in addition, a flange Ga. This flange Ga and the portion E of the truncated cone will be severed, i.e. cut, from the part C along the dash-dot line. However, for purposes of the coating process, the outwardly extending wall part G being an integral outer extension of the part C, is provided for purposes of receiving a cover plate E which is sealed to the flange Ga in a liquid-tight fashion. Cover E will remain in situ until the metal coating process has been completed. Only then will the part G, possible with E remaining in place, be severed along the dash-dot line as stated, so that now the part C assumes its final contour, shape, and dimension.

Reference character A denotes the container for the electrolytic bath, containing a liquid B, and the part C, together with extension G and cover E are immersed in the bath B. The cover E, however, is traversed by a tube F whose upper end extends above the surface level of bath B and, as far as the lower end of tube F is concerned, it extends into the hollow interior of part C. This tube F may be affixed to the cover E in a sealing fashion. It is also practical to have the inner extension of the tube F not extend beyond the plane of cutting (dash-dot line), so that this tube bath will not interfere with the cutting process. The tube F permits filling of part C after it has been sealed by the cover E, with an electrically neutral liquid D, for reasons mentioned already above and to be repeated briefly; the liquid D will avoid any pressure differential or at least compensate significantly any pressure differential between the inside and the outside of the part C. Such a pressure differential may occur particularly if the bath B gets hot during the electrolytic depositing process.

FIG. 2 illustrates a part C′ which may, in many aspects, resemble part C or even be identical therewith. The particular contour chosen for this example is on account of the obvious complexity in the shape and grade variation in the curvature on the inside as well as on the outside. In FIG. 2, however, the part C′ is not provided with open extension, such as G in FIG. 1, but the cover E′, so to speak, is an integral part of the extension G′. The dash-dot line again denotes the plane of cutting and severing so that G′ and E′ are to be removed following the completion of the electrolytic depositing process.

Cover part E′ is formed also as an integral part of the extension G′ during the making of the part C′. This, of course, requires that the tube F, in this case, is also made as an insertion into the part E′ during the manufacture of the part C′. Otherwise, the situation is similar in FIG. 1, and particularly the process operation is the same.

FIGS. 1 and 2 illustrate complex-contoured parts which are to be covered by a metallizing process on, what can be termed the outside only. The figures demonstrate that the invention permits protection of the interior of these hollow complex parts. If these or others (comparable in surface contour complexity) are to be coated on the outside only in certain surface portions, the conventional method of covering the portions not to be metallized has to be followed.

In summary, the coating process is to be carried out by the following steps but not necessarily in the stated sequence.

First, (always) one begins with the making of the part or component such as C or C′, usually by way of laminate construction or form parts, whereby the extensions G and G′, as well as E′ are considered integral parts of the component being made even though these extensions are, in fact, superfluous as far as the final product is concerned. Included in the manufacture here, particularly in the case of C′ is the inclusion of a tube F. As far as FIG. 1 is concerned, the cover E is made separately, including the insertion of the tube F, and this part is then sealingly affixed, possibly permanently affixed to the extension G of part C. In the case of FIG. 2, the inclusion of tube F is integral with process of making part C′.

Second, (for practical purposes to follow the first step) whatever surface portions on the outside are not to be covered with a metal coating, is masked in a usual fashion, i.e. conventional methods are used here which pose no difficulties simply because these surfaces are, as defined and established on the outside the hollow interior of the part has been sealed off at this time.

Third, the part and component C, C′ is, possibly, mechanically but always chemically prepared, basically by a removal process of any surface coating on the outside, involving only unmasked surface parts. The interior of the parts C and C′ remain uneffected by this preparatory step. This step may occur later.

Fourth, unless sealing has not been carried out earlier, it is now carried out to seal off the interior of part C. In the case of C′, sealing is inherent. In other words, the third and fourth steps could be interchanged.

Fifth, the interior of the part C and/or C′ is filled through the respective tube F with an electrically neutral liquid. This step is carried out after completion of the third and fourth steps in either sequence.

Sixth, the unmasked outer surfaces are now exposed to an electrolytic process such as immersion into the electrolytic bath B and subjecting these exposed surfaces to the depositing process to the extent it is needed.

Seventh, the final step following the removal of the part from the bath B is to cut off the extension (G, G′) which was needed only for purposes of closing the interior or whatever hollow existed and was not to be covered by the electrolytic depositing process. The severing will complete the part and component to be made, at least as far as outer contour and shape is concerned. There may, of course, be finishing operations that follow.

The invention is not limited to the embodiments described above; but all changes and modifications thereof, not constituting departures from the spirit and scopy of the invention are intended to be included.

I claim:

1. In a method of metallizing a part or component by means of electrolytic process, the part or component being made of a fiber re-inforced compound and being, at least in parts, hollow or concave, whereby a hollow or concave portion is not to be metallized, the improvement comprising:

providing the part or component with a wall extension adjacent the hollow or concave portion not to be metallized;

closing off and liquid tight sealing said hollow or concave portion under utilization of said wall extension so that a hollow interior is sealed off while providing for liquid-venting communication;

immersing the part in an electrolytic bath while the interior of the hollow or concave portion as closed off remains in liquid venting communication with the exterior of that bath;

electrolytically depositing metal on at least some of the outer surface parts of said part to the extent not included in the closed off portion; and removing the closure as well as the wall extension after completion of the depositing process.

2. Method as in claim 1 and including the step of filling the closed off interior with an electrically neutral liquid.

3. Method as in claim 1 wherein said wall extension is an integral part of the part as it is being made prior to the depositing process.

4. Method as in claim 1 wherein said wall extension is an all around extension with a flange, the closing including utilization of a cover that is sealed to that flange.

5. Method as in claim 1 wherein a surface cleaning step is interposed between the depositing step and the providing step.

6. In a method of metallizing a part or component by means of electrolytic process, the part or component being made of a fiber re-inforced compound and being, at least in parts, hollow or concave, whereby a hollow or concave portion is not to be metallized, and wherein prior to a depositing and metallizing step a cleaning step is provided for, the improvement comprising:

providing the part or component with an integral wall extension adjacent the hollow or concave portion not to be metallized, said providing step preceding said cleaning step;

closing off said hollow or concave portion under utilization of said wall extension so that a hollow interior is sealed off while providing for liquid-venting communication;

immersing the part in an electrolytic bath while the interior of the hollow or concave portion as closed off remains in liquid venting communcation with the exterior of that bath;

electrolytically depositing metal on at least some of the outer surface parts of said part to the extent not included in the closed off portion; and removing the closure as well as the wall extension after completion of the depositing process.

7. Method as in claim 6 and including the step of filling the closed off interior with an electrically neutral liquid.

8. In a method metallizing a part or component by means of electrolytic process, the part or component being made of a fiber re-inforced compound and being, at least in parts, hollow or concave, whereby a hollow or concave portion is not to be metallized, the improvement comprising:

closing off and liquid tight sealing said hollow or concave portion under utilization of said wall extension so that a hollow interior is sealed off while providing for liquid-venting communication;

immersing the part in an electrolytic bath while the interior of the hollow or concave portion as closed off remains in liquid venting communication with the exterior of that bath;

electrolytically depositing metal on at least some of the outer surface parts of said part to the extent not included in the closed off portion; and removing the closure after completion of the depositing process.

9. Method as in claim 8 and including the step of filling the closed off interior with an electrically neutral liquid.

10. Method as in claim 8, wherein the closing off step concurs with a step of providing the part or component with a wall extension adjacent to the hollow or concave portion not to be metallized; and removing the closure together with the wall extension after completion of the depositing step.

* * * * *